US006481655B1

(12) United States Patent
Feigel, Jr.

(10) Patent No.: US 6,481,655 B1
(45) Date of Patent: Nov. 19, 2002

(54) ROTOR FOR A CRUSHING MACHINE

(75) Inventor: Kurt R. Feigel, Jr., Edmonton (CA)

(73) Assignee: Universe Machine Corporation, Edmonton (CA)

( * ) Notice: Subject to any disclaimer, the term of this patent is extended or adjusted under 35 U.S.C. 154(b) by 0 days.

(21) Appl. No.: 09/536,602

(22) Filed: Mar. 28, 2000

(51) Int. Cl.[7] ..... B02C 18/18
(52) U.S. Cl. ..... 241/294
(58) Field of Search ..... 241/294, 295, 241/242, 189.1, 195

(56) References Cited

U.S. PATENT DOCUMENTS

| | | | | |
|---|---|---|---|---|
| 2,534,302 A | * | 12/1950 | Sennholtz | 241/197 |
| 2,665,851 A | * | 1/1954 | Strehlow | 241/294 |
| 3,823,878 A | | 7/1974 | Ishikura | |
| 5,100,070 A | * | 3/1992 | Montgomery | 241/294 |
| 5,165,611 A | | 11/1992 | Ragnarsson | |
| 5,320,292 A | * | 6/1994 | Smith | 241/294 |
| 5,452,860 A | * | 9/1995 | Williams | 241/294 |

OTHER PUBLICATIONS

West Salem Machinery, "Power Rotor" product information, 4 pages, Mar. 1995.

* cited by examiner

*Primary Examiner*—Mark Rosenbaum
(74) *Attorney, Agent, or Firm*—Anthony R. Lambert

(57) ABSTRACT

A rotor for a crushing machine has a central block mounted on a shaft for rotation. The central block has tapered blade mounting faces circumferentially spaced about the central block. A blade is secured to each tapered blade mounting face. Each blade has a tapered rotor mounting face matching the tapered blade mounting face. Each blade is secured to the rotor by a pin to pull the tapered rotor mounting face of the corresponding blade against a corresponding tapered blade mounting face of the rotor and lock the corresponding blade onto the rotor by frictional locking of the tapered blade mounting face and the tapered rotor mounting face. Each blade preferably has a square impact face with four cutting edges and the tapered blade. mounting face. and tapered rotor mounting face match in four rotational positions so that each blade is rotatable to place any one of its four cutting edges on the outer periphery of the rotor.

4 Claims, 6 Drawing Sheets

ROTOR FOR A CRUSHING MACHINE

FIELD OF THE INVENTION

This invention relates to rotors used in crushing machines.

BACKGROUND OF THE INVENTION

Crushing machines used for shredding wood are well known that use a central rotor with multiple crushing faces formed around a central block with several flutes. Rectangular blades are secured to the crushing faces. The blades impact wood placed into the crushing machines and shred the wood. The blades tend to wear out with time, particularly when rock contaminants are interspersed with the wood, and also may loosen on the rotor. This invention is directed to an improved rotor with improved servicing and securing of the blades.

SUMMARY OF THE INVENTION

There is thus provided in accordance with an embodiment of the invention, a rotor for a crushing machine, the rotor comprising:

a central block mounted on a shaft for rotation;

the central block having tapered blade mounting faces circumferentially spaced about the central block;

a blade secured to each tapered blade mounting face, each blade having a tapered rotor mounting face, the tapered rotor mounting face engaging the tapered blade mounting face along tapered portions of the tapered rotor mounting face and the tapered blade mounting face; and plural pins, each pin associated with and secured to a corresponding blade, each pin being secured to the rotor to pull the tapered rotor mounting face of the corresponding blade against a corresponding tapered blade mounting face of the rotor and lock the corresponding blade onto the rotor by frictional locking of the tapered blade mounting lace and the tapered rotor mounting face.

According to a further aspect of the invention, for each blade, one of the corresponding tapered blade mounting face and the tapered rotor mounting face of the blade forms a depression and the other of the tapered blade mounting face and the tapered rotor mounting face form is an elevation.

According to a further aspect of the invention, each blade has a square impact face with four cutting edges and the tapered blade mounting face and tapered rotor mounting face match in four rotational positions so that each blade may be easily rotated to place any one of its four cutting edges on the outer periphery of the rotor.

According to a further aspect of the invention, one of the tapered blade mounting face and the tapered rotor mounting face incorporates a conical depression, and the other of the tapered blade mounting face and the tapered rotor mounting face incorporates a matching conical elevation.

According to a further aspect of the invention, each pin is threaded into the corresponding blade.

According to a further aspect of the invention, there is provided a rotor for a crushing machine, the rotor comprising:

a central block mounted on a shaft for rotation;

the central block having blade mounting faces circumferentially spaced about the central block;

a blade secured to each blade mounting face, each blade having a rotor mounting face that matches the blade mounting face to which the blade is secured; and each blade having a square impact face with four edges and the blade mounting face and rotor mounting face matching in four rotational positions so that each blade is rotatable to place any one of its four edges on the outer periphery of the rotor.

These and other aspects of the invention are described in the detailed description of the invention and claimed in the claims that follow.

BRIEF DESCRIPTION OF THE DRAWINGS

There will now be described preferred embodiments of the invention, with reference to the drawings, by way of illustration only and not with the intention of limiting the scope of the invention, in which like numerals denote like elements and in which.

DETAILED DESCRIPTION OF PREFERRED EMBODIMENTS

In this patent document, the word "comprising" is used in its non-limiting sense to mean that items following the word in the sentence are included and that items not specifically mentioned are not excluded. The use of the indefinite article "a" in the claims before an element means that one of the elements is specified, but does not specifically exclude others of the elements being present, unless, unless the context clearly requires that there be one and only one of the elements.

Figure 1:
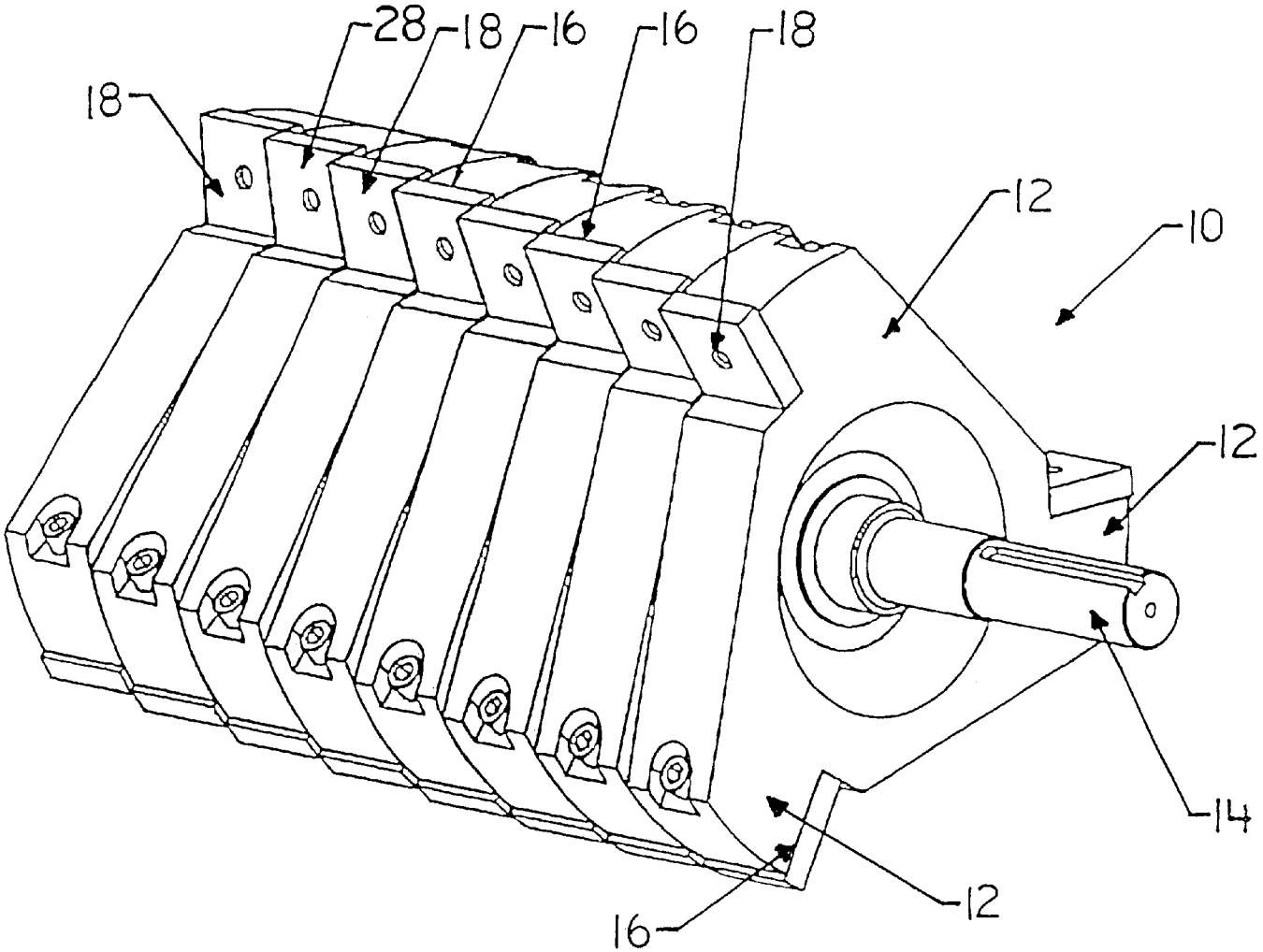
FIG. 1 is a perspective view of a rotor according to the invention.
Figure 2:
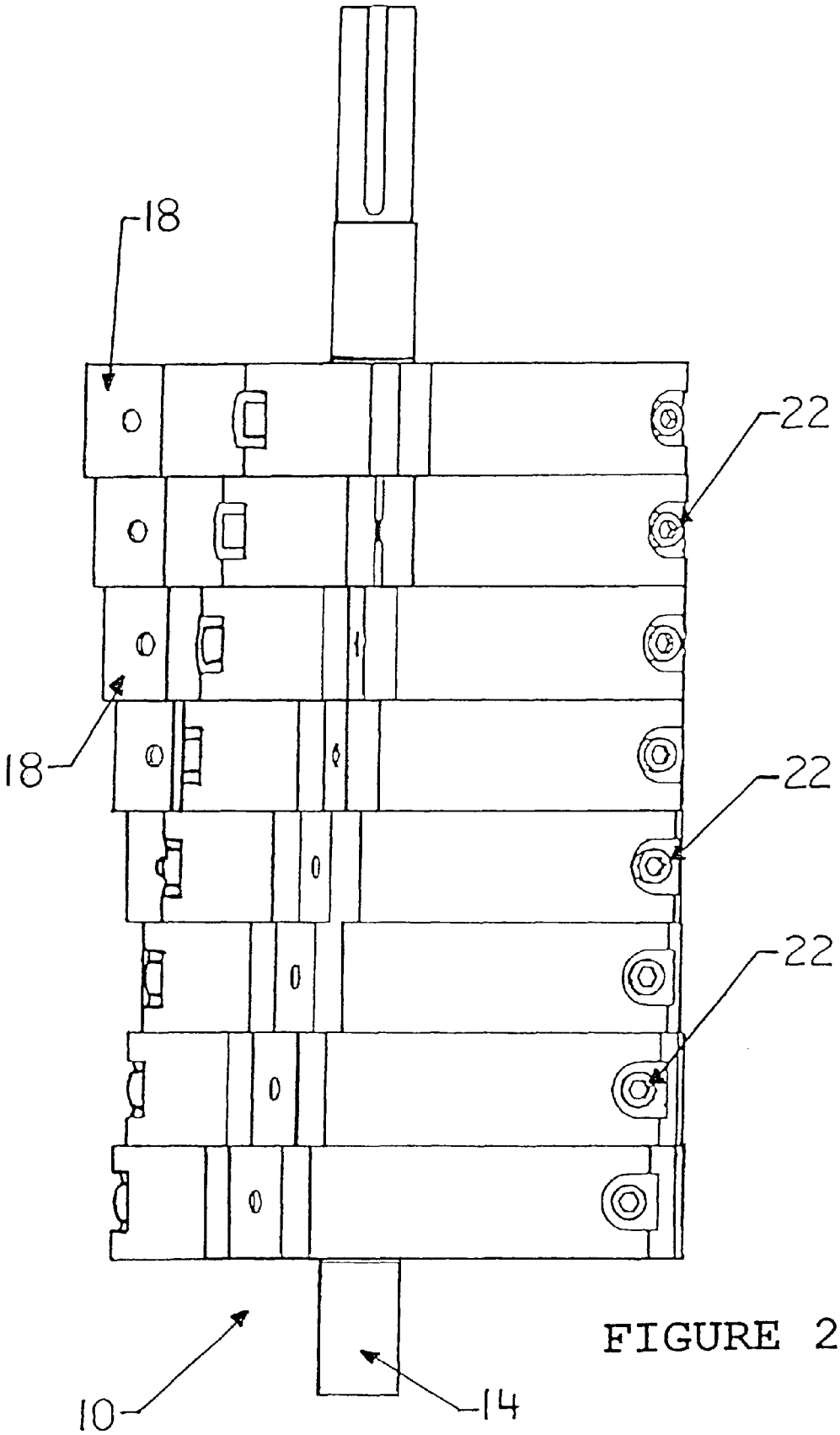
FIG. 2 is a side view of the rotor of FIG. 1.
Figure 5:
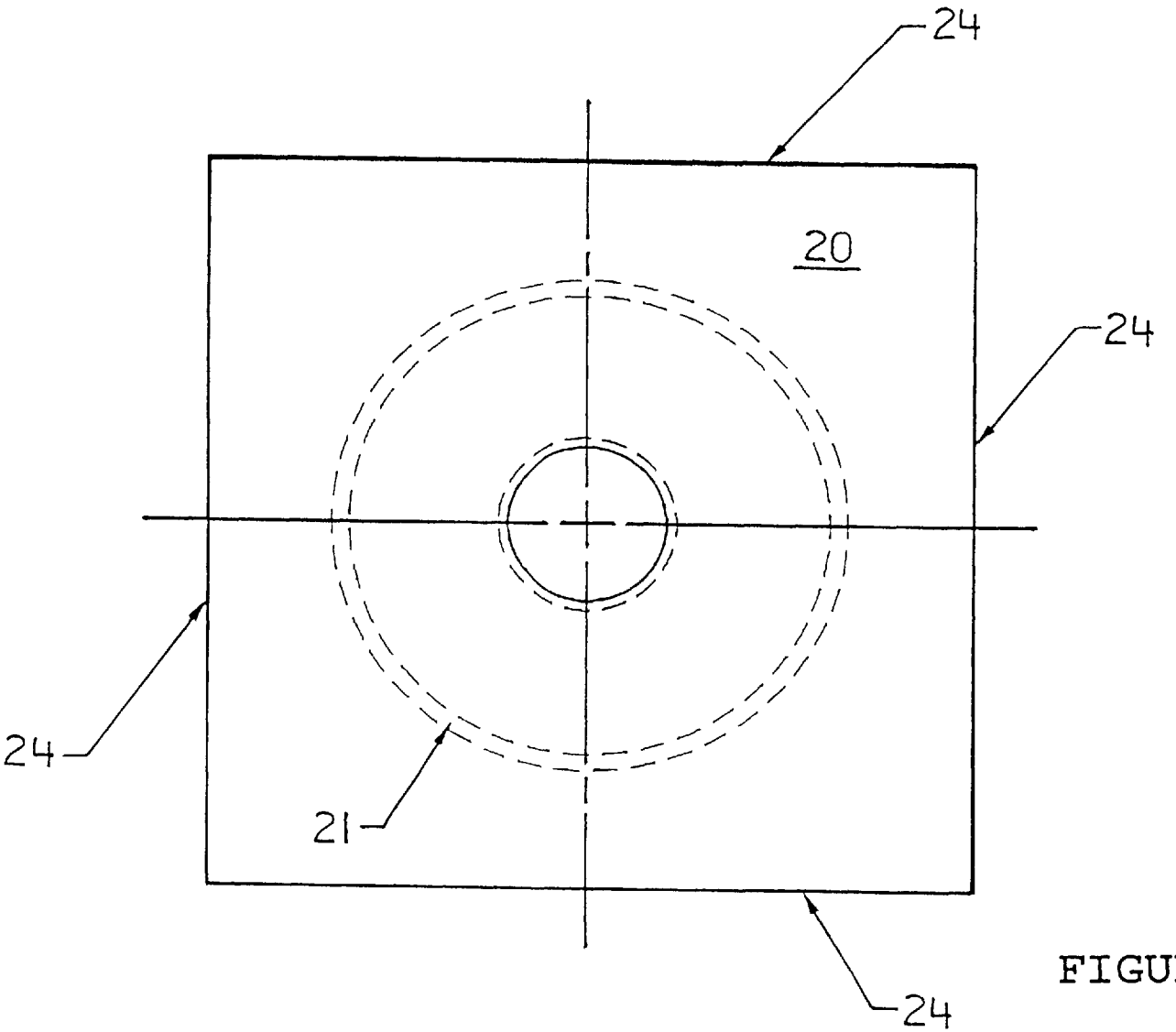
FIG. 5 is a plan view of the bottom side of a blade used with the rotor of FIG. 1.

FIG. 1 shows a rotor 10 for a crushing machine (not shown), such as the Universe HOG made by Universe Machine Corporation of Edmonton, Alberta, Canada. Apart from what is disclosed here, the crushing machine is otherwise conventional and not further described. These crushing machines are used for crushing of waste material, and are designed to be able to handle contaminants such as rock. The rotor 10 is formed as a central block with a series of circumferentially spaced flutes 12. Three are shown but there could be fewer, or more, such as four. Three and four flute rotors are commonly used. The central block is mounted for rotation on a shaft 14 which is received by the crushing machine. Each flute 12 has a series of axially extending blade mounting faces 16. Each blade mounting face 16 is preferably oriented perpendicularly to the direction of motion of the flute 12. Successive blade mounting faces 16 are circumferentially offset from each other in conventional manner. Striker plates or blades 18 are secured to the blade mounting faces 16. Each blade 18 has a corresponding rotor mounting face 20 shown in more detail in FIGS. 5 and 6. The rotor mounting faces 20 match the blade mounting faces 16 for frictional locking. Each blade mounting face 16 is tapered. For example, at least two opposed portions of the blade mounting face 16 may be oriented at an angle $\pm\alpha$ to a perpendicular to the general orientation of the blade mounting face 16 such that $0°<\alpha<90°$, so that the blade mounting face 16 is either convex or concave. Preferably, $\alpha<45°$, for example 15°. The rotor mounting faces 20 of the blades 18 are correspondingly tapered for a close but not exact fit to the blade mounting faces 16. The tapered portions of the blade mounting faces 16 and the rotor mounting faces 20 should be so located on the rotor 10 and blades 18 that the blades 18 may be locked by friction onto the rotor 10. To allow for frictional locking, the flat portions of the faces 16 and 20 should not touch, with the contact being along the angled or tapered portion of the faces 16 and 20. This may be achieved by for example making the elevation slightly larger than the depression. For a six inch wide blade, a gap of about 1/32 inches is acceptable between the flat portions of the faces 16 and 20. It is desirable to minimize this gap without there being actual contact along the flat portions of the faces 16 and 20. If there is too much contact between flat faces, the frictional lock is diminished and may be eliminated. To ensure stability of the blade 18, it is preferred that the tapered portion of the faces 16 and 20 occupy a substantial portion of the faces, for example the width of the tapered portion is more than half the width of the blade.

Force is required to bole the blade mounting faces 16 and the rotor mounting faces 20 frictionally locked. For his purpose, pins 22. for example socket cap screws, one pin associated with and secured to each blade 18 pass through holes in the flutes 12 and are threaded into the blades 18. Each pin 22 is thus secured to the rotor 10 to pull the rotor mounting face 20 of the corresponding blade 18 against a corresponding tapered blade mounting face 16 of the rotor 12. The pins 22 thus lock the corresponding blades 16 onto the rotor 12 by frictional engagement of the tapered blade mounting face 16 and the tapered rotor mounting face 20. The pins 22 may also pass through countersunk holes in the blades 18 and thread into the rotor 10. Since the countersunk holes weaken the blades 18, care must be taken to ensure the blades are thick enough to avoid easily being broken.

Figure 4:
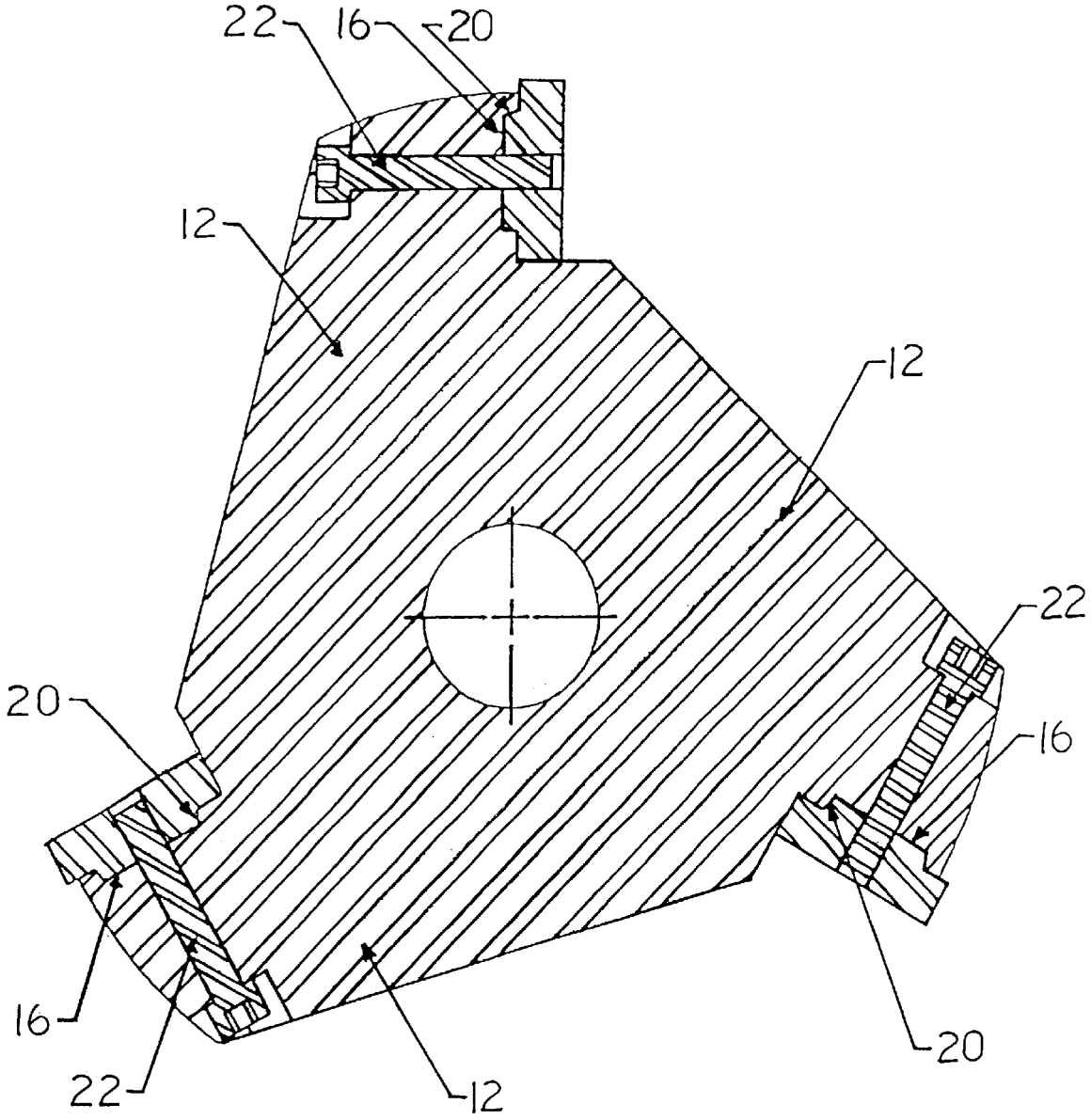
FIG. 4 is a section through he rotor of FIG. 1.
Figure 6:
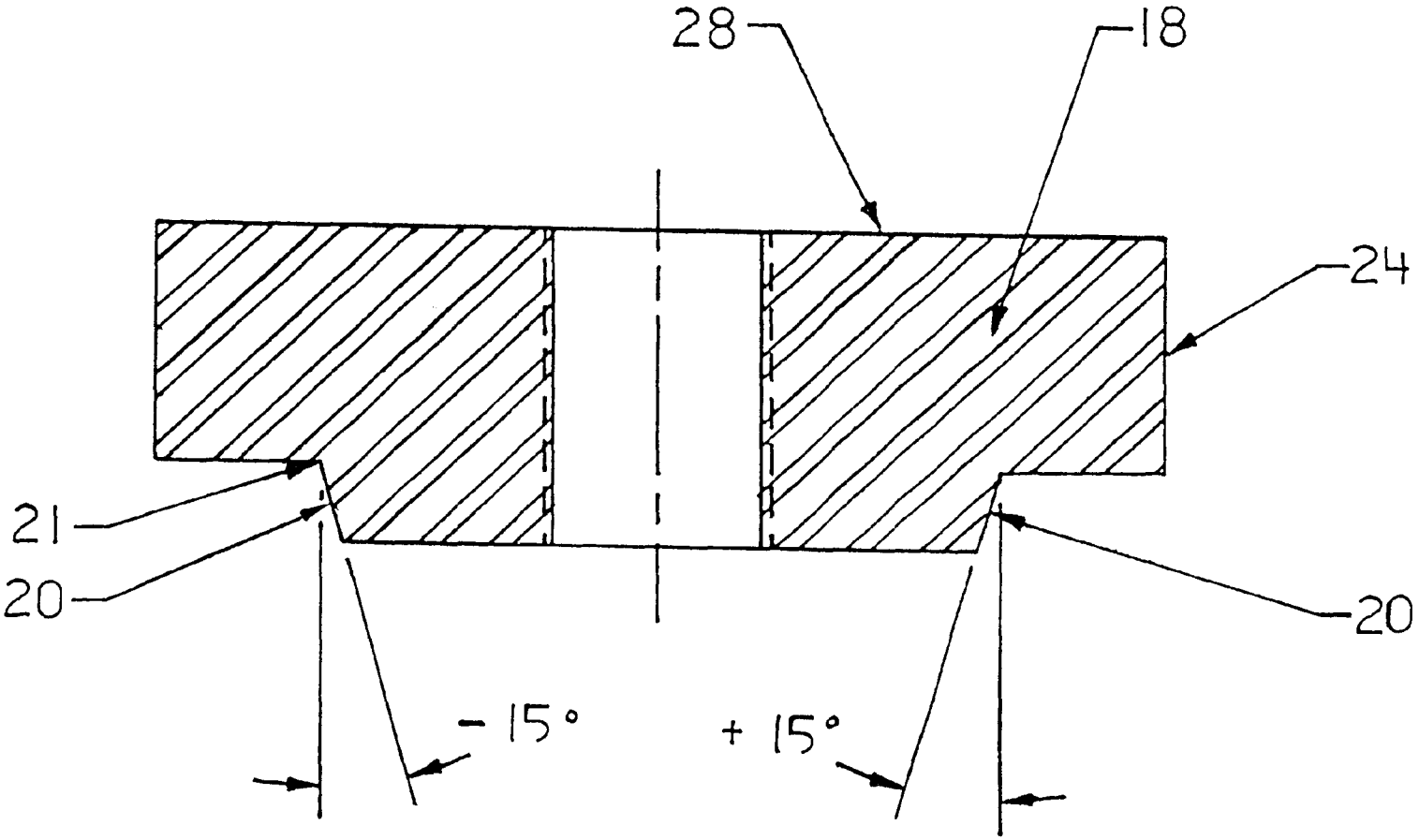
FIG. 6 is a section through the blade of FIG. 5.

Although the opposed tapered portions of the rotor mounting faces 20 may form ridges it is preferred that the rotor mounting faces 20 are tapered to form conical elevations 21 as illustrated in FIG. 6. The corresponding blade mounting faces 16 then form conical depressions as illustrated in FIG. 4, with parts of the elevation extending above the flat portions of the rotor mounting face 20 slightly more than equal diameter parts of the depression are recessed from the blade mounting face 16 to allow for frictional locking of the depression with the elevation before contact occurs on the flat portions of the faces 16 and 20.

When the blade mounting faces 16 form ridges, the blades may be rotated into two rotational positions, 180° apart. That is, there are two rotational positions of the blade mounting faces 16 that are identical to each other. A blade 18 may then have two cutting edges 24 opposed to each other, and may be placed initially with one cutting edge 24 at the outer periphery of the rotor, and when that wears out may be rotated 180° so that the other cutting edge 24 is at the outer periphery of the rotor 10. Preferably, however, the blades 18 have square impact faces 28 with four equal cutting edges 24, and the tapered blade mounting face 16 and tapered rotor mounting face 20 match in four rotational positions so that each blade may be easily road, in 90° increments, to place any one of its four edges 24 on the outer periphery of the rotor 10. A conical depression or elevation may match in infinite positions, including the four positions at 90° to each other. A conical depression or elevation is easy to machine, though the depression and elevation could be a section of a square pyramid (square, with sloping sides), or any of a variety of shapes that allow rotation of the blade to place any one of its cutting edges at the outer periphery of the rotor. Either the blade 18 may have the elevation or the rotor 10, and the other the depression. As shown, it is preferred that the rotor mounting face 20 be raised, the blade mounting face 16 be depressed.

Figure 3:
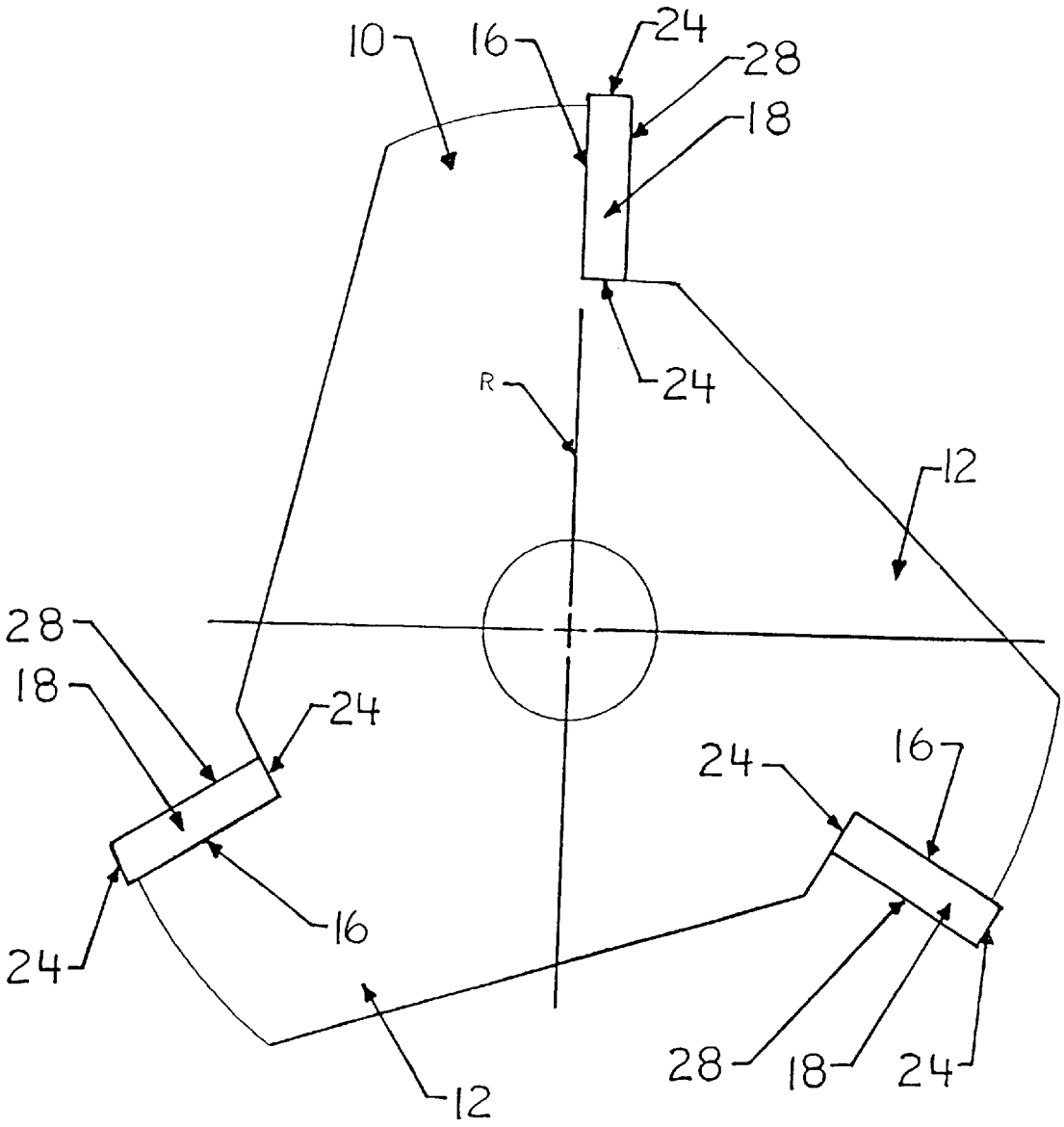
FIG. 3 is an end view of the rotor of FIG. 1.

The blades 18 and rotor 20 should all be made of materials that are strong enough for the intended purpose. Such materials are well known and need not be described here. The blades 18 are preferably mounted square on the blade mounting faces 16, with the edges 24 at the outer periphery of the rotor 10 aligned parallel to the shaft 14. In addition, the impact face 28 of each blade 18 is preferably aligned so that it is essentially parallel to a radius R (see FIG. 3), aid the faces of the cutting edges 24 are each flat and perpendicular to the impact face 28, with consecutive faces of the cutting edges 24 each being perpendicular to each other. The cutting edges 24 are provided with low clearance with the interior of the crushing machine so they must be mounted carefully and making them with square edges facilitates making the required clearance.

As a cutting edge 24 of a blade 18 wears out, it may be rotated 90° and a fresh cutting edge 24 is placed into cutting position at the outer periphery of the rotor 10. Successive rotations place each cutting edge 24 into cutting position. Due to wear of the cutting edges 24, by the time the last cutting edge 24 is placed into cutting position, if all of the other cutting edges are too worn, it may be difficult to properly align the last cutting edge 24 and in practice it may be useful only to use three of the four cutting edges 24 before replacing the blade 18. Instead of a single conical depression/elevation for the matching faces, multiple depressions and elevations may be used. For rotation of the blade 18 into four positions, the depressions and elevations on the blade 18 must then be configured so that the blade is rotatable, as for example when there are four circular depressions/elevations on the blade and rotor arranged at for example the corners of a square. In this instance, a central depression and elevation may also be used, and the central depression could be located on a mounting face that has four elevations at the corners of the square. Various other configurations of depression and elevation having four fold symmetry about an axis perpendicular to the mounting faces may also be used, such as a cross shaped depression and elevation formed with intersecting troughs on one of the mounting faces and intersecting ridges on the other.

A person skilled in the art could make immaterial modifications to the invention described in this patent document without departing from the essence of the invention that is intended to be covered by the scope of the claims that follow.

The embodiments of the invention in which an exclusive property or privilege is claimed are defined as follows:

1. A rotor for a crushing machine, the rotor comprising:

a central block mounted on a shaft for rotation;

the central block having tapered blade mounting faces circumferentially spaced about the central block;

a blade secured to each tapered blade mounting face, each blade having a square impact face with four cutting edges, and having a rotor mounting face that matches the tapered blade mounting face to which the blade is secured;

the tapered blade mounting face and tapered rotor mounting face matching in four rotational positions so that each blade is rotatable to place any one of its four cutting edges on the outer periphery of the rotor;

one of the blade mounting face and the rotor mounting face incorporates a tapered depression, and the other of the blade mounting face and the rotor mounting face incorporates a matching tapered elevation for frictional locking of the tapered elevation and the tapered depression; and each blade being secured to the rotor by a corresponding one of plural pins, each pin being secured to the rotor to pull the rotor mounting face of the corresponding blade against a corresponding blade mounting face of the rotor and lock the corresponding blade onto the rotor by frictional locking of the blade mounting face and the rotor mounting face.

2. A rotor for a crushing machine, the rotor comprising:

a central block mounted on a shaft for rotation;

the central block having tapered blade mounting faces circumferentially spaced about the central block;

a blade secured to each tapered blade mounting face, each blade having a square impact face with four cutting edges, and having a rotor mounting face that matches the tapered blade mounting face to which the blade is secured;

the tapered blade mounting face and tapered rotor mounting face matching in four rotational positions so that each blade is rotatable to place any one of its four cutting edges on the outer periphery of the rotor;

one of the blade mounting face and the rotor mounting face incorporates a tapered depression, and the other of the blade mounting face and the rotor mounting face incorporates a matching tapered elevation for frictional locking of the tapered elevation and the tapered depression; and each blade being secured to the rotor by a corresponding one of plural pins, each pin being being passed through the rotor and threaded into the corresponding blade.

3. A rotor for a crushing machine, the rotor comprising:

a central block mounted on a shaft for rotation;

the central block having tapered blade mounting faces circumferentially spaced about the central block;

a blade secured to each tapered blade mounting face, each blade having a square impact face with four cutting edges, and having a rotor mounting face that matches the tapered blade mounting face to which the blade is secured;

the tapered blade mounting face and tapered rotor mounting face matching in four rotational positions so that each blade is rotatable to place any one of its four cutting edges on the outer periphery of the rotor;

one of the blade mounting face and the rotor mounting face incorporates a conical depression, and the other of the blade mounting face and the rotor mounting face incorporates a matching conical elevation for frictional locking of the tapered elevation and the tapered depression; and each blade being secured to the rotor by a corresponding one of plural pins, each pin being secured to the rotor to pull the rotor mounting face of the corresponding blade against a corresponding blade mounting face of the rotor and lock the corresponding blade onto the rotor by frictional locking of the blade mounting face and the rotor mounting face.

4. A rotor for a crushing machine, the rotor comprising:

a central block mounted on a shaft for rotation;

the central block having tapered blade mounting faces circumferentially spaced about the central block;

a blade secured to each tapered blade mounting face, each blade having a square impact face with four cutting edges, and having a rotor mounting face that matches the tapered blade mounting face to which the blade is secured;

the tapered blade mounting face and tapered rotor mounting face matching in four rotational positions so that each blade is rotatable to place any one of its four cutting edges on the outer periphery of the rotor;

one of the blade mounting face and the rotor mounting face incorporates a conical depression, and the other of the blade mounting face and the rotor mounting face incorporates a matching conical elevation for frictional locking of the tapered elevation and the tapered depression;

each blade being secured to the rotor by a corresponding one of plural pins, each pin being passed through the rotor and threaded into the corresponding blade.

* * * * *